United States Patent [19]

Nehls, Jr. et al.

[11] Patent Number: 4,765,828

[45] Date of Patent: Aug. 23, 1988

[54] METHOD AND APPARATUS FOR REDUCTION OF METAL OXIDES

[75] Inventors: George R. Nehls, Jr.; Scott D. Anderson, both of Duluth, Minn.

[73] Assignee: Minnesota Power & Light Company, Duluth, Minn.

[21] Appl. No.: 64,105

[22] Filed: Jun. 19, 1987

[51] Int. Cl.[4] ..... C22B 4/00

[52] U.S. Cl. ..... 75/10.19; 266/287

[58] Field of Search ..... 75/10.19, 10.20, 10.21, 75/10.22; 266/148, 287, 222; 373/22, 56

[56] References Cited

U.S. PATENT DOCUMENTS

| | | | |
|---|---|---|---|
| 2,819,423 | 1/1958 | Clark | 313/231 |
| 3,264,094 | 8/1966 | Robinson | 75/11 |
| 3,936,586 | 2/1976 | Tylko | 219/121 P |
| 4,177,060 | 12/1979 | Tylko | 75/10 R |
| 4,310,350 | 1/1982 | Santen | 75/10.19 |
| 4,518,419 | 5/1985 | Lugscheider et al. | 75/10 R |
| 4,571,259 | 2/1986 | Fey et al. | 75/10 R |
| 4,699,653 | 10/1987 | Barcza | 75/10.19 |

*Primary Examiner*—Peter D. Rosenberg

*Attorney, Agent, or Firm*—Merchant, Gould, Smith, Edell, Welter & Schmidt

[57] ABSTRACT

A method of reducing metal oxides comprises introducing feedstock material into a plasma torch reactor according to two different flow patterns. A primary feedstock is fed into the immediate vicinity of the plasma stream in a helical pattern surrounding the plasma stream. The primary feedstock material preferably comprises the metal oxides to be reduced within the reactor. A secondary feedstock material is fed at a more remote location, preferably in a flow pattern developing a protective wall for the inside of the reactor. A preferred assembly is provided for application of the process. For the preferred embodiment, the assembly comprises a top plate, a central ramp, a bottom plate and a liner to form separate feed channels for the primary and secondary feedstock.

23 Claims, 3 Drawing Sheets

FIG. 2
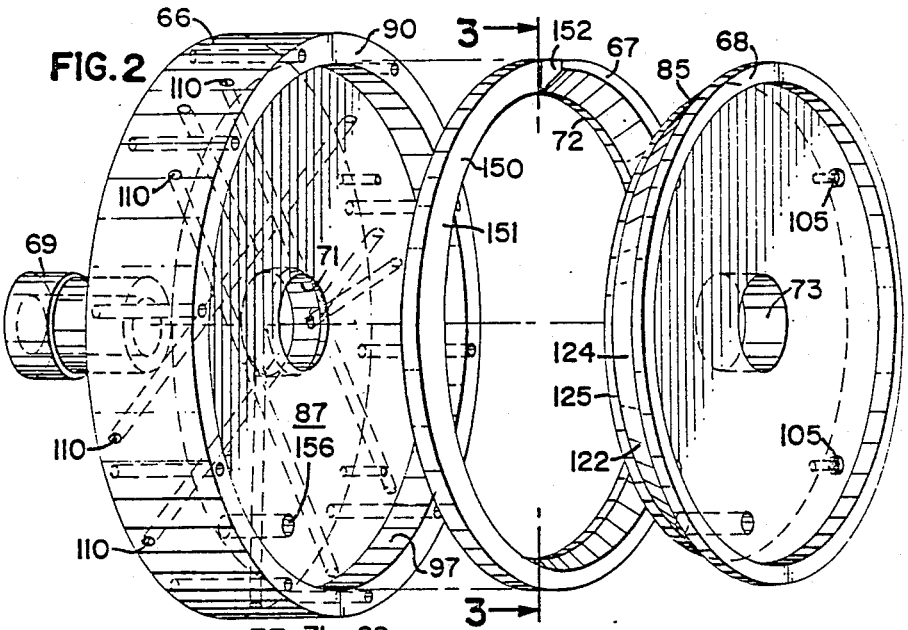
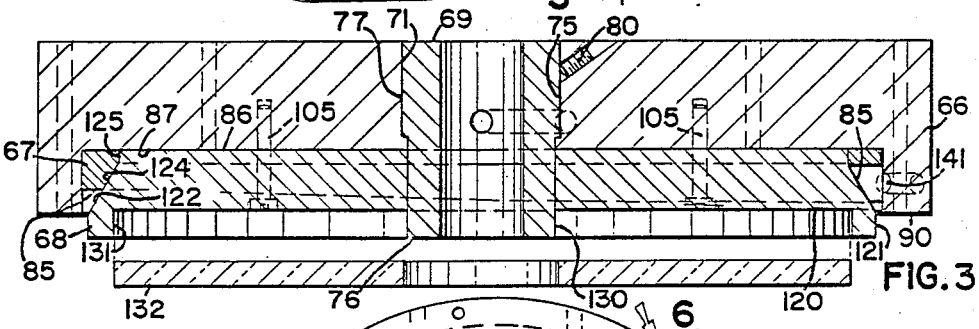
FIG. 3
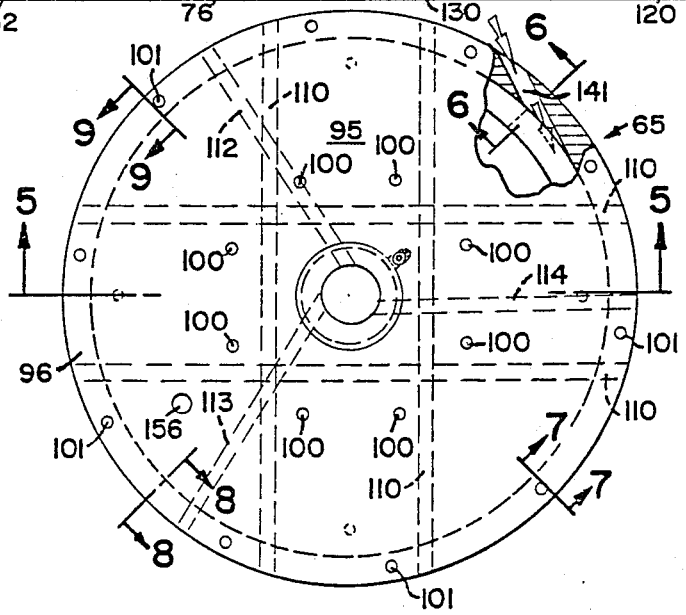
FIG. 4

METHOD AND APPARATUS FOR REDUCTION OF METAL OXIDES

FIELD OF THE INVENTION

The present invention generally relates to methods and apparatus for processing metal ores. In particular, the invention concerns processes and systems whereby metal oxides are reduced, at high temperature, in the presence of a reducing gas. Specifically, the invention concerns reducing towers wherein a plasma torch is used to heat metal oxides for reaction with a reducing gas comprising primarily carbon monoxide and hydrogen.

BACKGROUND OF THE INVENTION

Extracted metallurgy generally involves the feeding of metal ore into a plasma heated stream of reducing gas. Generally, the feedstock comprises a mixture of metal oxide(s), hydrocarbonaceous material and flux. The metal oxide comprises the powdered ore to be treated, for example iron oxides such as taconite. When heated sufficiently, and provided in contact with a reductant, the material will reduce to the non-oxidized metal. Typically, the reduced metal material, in a molten state, drains to a bottom of the reactor, where it can be collected and drained.

The gas stream from the plasma torch comprises an ionized stream of reducing gas, typically carbon monoxide and hydrogen, at very high temperature, often 10,000° F. or above. The metal oxides are fed into this stream, to be heated and reacted.

As previously indicated, for typical conventional operations the oxide is fed into the reactor in a feedstock stream, including hydrocarbonaceous material and flux. The hydrocarbonaceous material is typically a coal product. The hydrocarbonaceous material, in part, comprises the reductant which reacts with the heated oxides, to form carbon dioxide and water. Normal coal can be used for the carbonaceous material, however beneficiated coal is generally preferred. Beneficiated coal has a relatively high proportion of hydrogen to carbon content, while at the same time is low in moisture. The hydrocarbon or volatile fraction of beneficiated coal is high relative to other types of coal. For example, coal from the eastern part of the United States is generally low in volatiles, contains a relatively high percentage of aromatics, and is low in moisture content. Coal from the western part of the United States is generally high in volatiles, but also high in moisture. Beneficiated coal possesses the better, or more useful, characteristics of each.

Metal oxides include numerous silicates. The feedstock generally includes a flux therein, such as limestone, to reduce the melting temperature of the silicates, by forming calcium silicates. This facilitates the ore processing.

A plant for processing ore through utilization of a plasma torch generally comprises a reformer in communication with a reaction chamber or tower. The tower has a plasma torch mounted in an upper portion thereof, and a refractory lining. A feedstock comprising the metal oxides, carbonaceous material, and flux are generally fed, under gas pressure, into the plasma stream at or near the torch. The materials are heated substantially, and are blown outward from the torch area both downwardly and toward the refractory walls. Reducing gas in both the plasma torch and the gas used to propel the feedstock into the torch facilitates the reaction.

During the tower reaction, the metal oxides are reduced. The metal formed is typically hot enough to be molten and drips to the bottom of the tower into an awaiting crucible area from which it can be tapped. Slag material, such as silicates, may form on top of the pool of molten metal.

The gaseous products of the reaction generally comprise carbon dioxide and water. These gasses are directed through a reformer, packed with carbonaceous material. This process reduces the gasses, forming carbon monoxide and hydrogen. These gasses may then be collected and fed back into the plasma torch or the feedstock stream, as necessary.

Such conventional systems suffer from numerous problems. First, the refractory material lining the tower wall may be subject to considerable erosion or corrosion from hot feedstock material being thrown thereagainst, out of immediate proximity to the plasma torch. This results, in part, from the fact that the feedstock material is often fed directly into or near the hottest part of the torch area. Further, the metal oxides are only retained with the immediate proximity of the torch for a very brief period of time. Often this is so brief that the heated metal oxides cannot reach physical and chemical equilibria with the plasma gasses. That is, the oxides will not have been heated to as high a temperature as would be possible under a longer retention; and, further chemical reduction, which might have taken place in the plasma area had the retention time been longer, will have been inhibited.

Also, heating of the feedstock material in such systems is relatively energy inefficient, since the carbonaceous material and flux are also heated substantially by the plasma torch. That is, energy from the plasma torch is inefficiently used to heat the carbonaceous material and flux, when generally it is heating of the metal oxides that is most desired.

Further, as a result of dilution of the metal oxide with the flux and carbonaceous material, the zone immediately around the plasma torch is not as high in concentration of metal oxides as it might otherwise have been. Thus, only a relatively small amount of metal oxides can be passed through the torch zone at any given time.

Typical refractory materials comprise alumina or burnt chrome. The material is applied to the inside of a tower in a layer, in most instances about six inches to one foot thick. This is a relatively expensive liner, but one that has been necessary to withstand the extreme temperatures in the reaction tower. Often the expensive refractory material is backed by a lining of fire brick or the like, less efficient in retaining the heat but operable in most instances.

As previously suggested, when the heated metal oxides and other material are thrown against the refractory wall, erosion or corrosion occurs. This leads to damage of the refractory material, and a need for relatively frequent replacement. This is expensive not only in terms of material costs, but also in terms of plant down time, for servicing.

What has been needed has been a more efficient method of processing ore through the utilization of a plasma torch and reaction tower, and an apparatus for accomplishing such a method which is substantially less prone to the problems outlined.

OBJECTS OF THE INVENTION

Therefore, the objects of the present invention are: to provide a method of reducing ores in a reaction assembly utilizing a plasma torch energy source; to provide an arrangement for operation of the method wherein efficiency is enhanced through accomplishment of an increased retention time for metal oxides in the immediate vicinity of the plasma torch; to provide such an arrangement wherein feedstock to the plasma zone is preferably substantially free from carbonaceous material and flux; to provide such a method and apparatus wherein the carbonaceous material and flux are introduced in a manner forming a protective wall over refractory material in the reaction chamber; to provide such an arrangement wherein the plasma torch is mounted to an assembly comprising a feed plate having means therein for directing feedstock into the immediate torch zone; to provide such an assembly wherein the feed plate includes means for directing the feedstock into the torch zone in a generally helical pattern; to provide such an arrangement wherein the feed plate includes a second feedstock directing means by which carbonaceous material and flux may be introduced into the reaction chamber; to provide such an arrangement wherein the second feedstock directing means generates a falling and preferably swirling layer of the second feedstock mixture to protect the refractory lining of the reaction chamber from feedstock material fed into the plasma torch area; to provide such an arrangement wherein the plasma torch mounting plate comprises a primary mounting disk or plate, a central second feedstock directing member, and a third, inner, directing plate; to provide such an arrangement wherein the torch is mounted to the primary disk with hot gasses from the torch passing through a central aperture in the main disk; to provide such an arrangement wherein the main disk includes cooling means therein and a central liner mounted in the central aperture; to provide such an arrangement wherein the central second feedstock directing means is removable and replaceable; to provide such an apparatus which is relatively simple to manufacture and assemble, which is relatively simple to use and which is particularly well suited for the proposed usages thereof. Other objects and advantages of this invention will become apparent from the following descriptions, taken in connection with the accompanying drawings, wherein are set forth by way of illustration and example various embodiments of the present invention.

SUMMARY OF THE INVENTION

The present invention comprises a method and apparatus for refining oxides, such as iron oxides, chromium oxides, silicon oxides, manganese oxides, vanadium oxides, nickel oxides and mixtures thereof. It will be readily understood that the principles of the invention may be applied to a variety of reaction systems, including those involving other materials.

The method comprises a variation in conventional metal refining processes. Generally, a reaction chamber is provided having an upper end, with a plasma torch mounting plate thereon, and a lower end in communication with a crucible area for receiving molten metal. The reaction chamber is generally lined with a refractory material such as alumina or the like, as an insulator. An upper portion of the reaction chamber is typically capped by the plasma torch mounting plate, which has a relatively narrow central aperture therein. A conventional plasma torch is mounted on the mounting plate, to provide introduction of a plasma fluid into the reaction chamber. The hot fluid from the plasma torch generally extends into the reaction chamber through a central aperture in the mounting plate. The plasma torch may be of any conventional type, generally creating a plasma stream having a temperature of 10,000°-30,000° F., or more.

A primary or first feedstock is fed into the immediate zone of the torch, generally into the aperture in the main feed plate, by means of channels communicating therewith. A first improvement according to the present invention involves the manner in which the feedstock is transmitted into the central aperture, or immediate torch zone. In conventional systems, the feedstock is often fed directly into the torch zone, or it is fed into a large chamber area surrounding the plasma torch. According to the present invention, the feedstock is fed into the central aperture generally offset from a center thereof, to form a swirling or helical pattern in close proximity to a center of the plasma stream. Preferably three feed channels are used, spaced approximately 120° apart from one another. As a result, the feedstock swirls into the torch zone, with two major advantages. The first is that the swirling pattern keeps the feedstock in the immediate area of the torch for a longer period of time than if the feedstock were fed directly into the center of the torch. The second is that once heated, the feedstock material is not rebounded directly against a single area of the chamber refractory material with as great a frequency. That is, heated feedstock material will be repelled by the plasma torch in all radial directions substantially evenly. This results in less wear on any particular portion of the refractory wall.

A second substantial improvement according to the present invention concerns the nature of the feedstock material fed directly into the torch zone. In conventional refining processes, the feedstock fed into the torch zone typically comprises the metal oxides to be refined, mixed with reducing material such as hydrocarbonaceous material, and also often flux material. According to the present invention, the feedstock introduced into immediate proximity with the plasma torch comprises substantially only the metal oxide ores to be refined, reducing hydrocarbonaceous material and flux being introduced elsewhere as a second or secondary feedstock.

Substantial advantages result from this arrangement. First, the plasma torch is made more efficient, since energy is not lost in substantially heating the flux and hydrocarbonaceous material. Secondly, a higher concentration of ore material may be retained in the immediate proximity of the plasma torch, for a substantially greater period of time. As a result, the ore material is more rapidly heated into both physical and chemical equilibria with the plasma. While equilibria might not be completely achieved, depending upon the rate of flow through the torch area, it typically will be at least approached to a greater extent than with typical previous known methods. As a result, more metal reduction is likely to occur in the immediate area of the plasma torch, at a faster rate. Thus, overall refining is generally made more efficient.

Also, as will be described below, the feedstock materials comprising hydrocarbonaceous material and, if necessary, flux, can be fed into the reaction chamber via a different pathway, to advantage. The use of this secondary feedstock material will be described in further detail below.

Generally, the main mounting plate to which the plasma torch is mounted will become substantially hot during use. A preferred such plate is cooled by means of a cooling liquid flow pumped through passageways therein, such as water passageways extending through the cap. A copper plate for the main mounting plate may be desired, due to its high thermal conductivity. That is, while it may be greatly heated from the plasma torch, it may also be fairly efficiently cooled by the cooling water flow. Thus, while a copper plate may have a relatively low melting point, it can be efficiently cooled and effectively utilized.

According to a preferred embodiment of the present invention, when a copper plate is used as the main mounting plate for the plasma torch, the central aperture is lined with a material having a high melting point and relatively low thermal conductivity. For example, a liner comprising steel or a refractory material may be used. Such a liner is used in the relatively narrow central aperture, through which the plasma jet extends. As a result of the liner, the temperature gradient across the central aperture is reduced somewhat, or at least the temperature falls off less rapidly as the wall of the aperture is approached. The result is an effective greater diameter of high temperature reaction zone in and near the plasma torch, leading to a more efficient refining process. The relatively small diameter of the central aperture, assures that at least initially, the primary feedstock is fed into very close proximity to the plasma stream.

Substantial advantages, according to the invention, are derived from the manner in which the secondary feed stock material, comprising the hydrocarbonaceous reducing material and, if necessary, flux, is introduced into the reaction chamber. According to the present invention, the material is delivered as a protective wall or lining substantially covering the refractory lining of the reaction chamber. A preferred arrangement leads to a swirling liner, so that the length of time it takes the secondary feed stock material to fall to the bottom of the reaction chamber is effectively extended.

In a typical embodiment of the present invention, the reaction chamber comprises a circular tower, and the liner of secondary feed stock material forms a circular protective wall along the refractory liner. Generally, the secondary feed stock material is forced into the reaction chamber, under gas pressure, along a trajectory more or less tangent to an interior surface of the refractory wall. This causes a swirling pattern, as the secondary feed stock material falls.

Preferably, the secondary feed stock material will be sufficiently heated within the reaction chamber to partially stick to the refractory wall, increasing protection of the refractory material from hot metal oxides ejected from the torch zone. Further, the falling protective wall will itself provide protection, as heated metal oxide material shot outwardly from the torch zone will be likely to encounter material in the protective wall, before getting through to the refractory material. The material of the protective wall will generally react with the metal oxides, to reduce same, forming carbon dioxide and water as well as the refined metal material, which can drip or fall to the bottom of the reaction chamber.

In a preferred application of the present invention, the secondary feed stock material is formed into a protective wall of substantially uniform thickness and composition throughout its entire radial extension. This is accomplished by introducing the secondary feed stock material into the reaction chamber in such a manner that a relatively even thickness of protective wall is produced. This is preferably accomplished through utilization of a spiral ramp arrangement. As a result of the ramp arrangement, as the secondary feed stock flows into the reaction chamber, along the path of the spiral ramp, it begins to fall off of the ramp downwardly through the reaction chamber, swirling in a somewhat helical pattern. When the powdered secondary feed stock material, and carrier gas, first enters the reaction chamber, a certain portion begins to fall outwardly from the ramp. The preferred ramp decreases in size throughout its entire length, so that a substantially constant carrier flow outwardly therefrom occurs throughout its entire extent. This may be accomplished throughout a variety of ramp designs, a preferred one of which is illustrated in the drawings and described in greater detail below.

According to the preferred embodiment, the ramp for introduction to the secondary feed stock is formed from a three component cap in an upper portion of the reaction chamber. The first component of the cap comprises the end plate on which the plasma reactor is mounted. The second, and central, component of the cap assembly comprises the ramp itself, formed in a ring. A third component comprises a lower end cap which retains the ring against the first, upper, end cap. Preferably, the assembly can be readily disassembled for cleaning, and if desired for changing the conformation of the internal ring and thus the ramp.

The drawings constitute a part of this specification and include exemplary embodiments of the present invention, while illustrating various objects and features thereof. In some instances relative material thicknesses and relative component sizes may be shown exaggerated, to facilitate an understanding of the invention.

BRIEF DESCRIPTION OF THE DRAWINGS

FIG. 2 is an exploded perspective view of a preferred feed plate assembly according to the present invention; phantom lines indicating features out-of-view.

FIG. 3 is a partially exploded side cross-sectional view of an end plate assembly taken generally along lines 3—3, FIG. 2; phantom lines indicating features out-of-view.

FIG. 4 is a top plan view of the feed plate assembly shown in FIG. 3, and with portions broken away to show internal detail and with phantom lines indicating portions out-of-view.

DETAILED DESCRIPTION OF THE PREFERRED EMBODIMENT

As required, detailed embodiments of the present invention are disclosed herein. However, it is to be understood that the disclosed embodiments are merely exemplary of the invention, which may be embodied in various forms. Therefore, specific structural and functional details disclosed herein are not to be interpreted as limiting, but rather as a basis for the claims and as a representative basis for teaching one skilled in the art to variously employ the present invention in virtually appropriately detailed structure.

Figure 1:
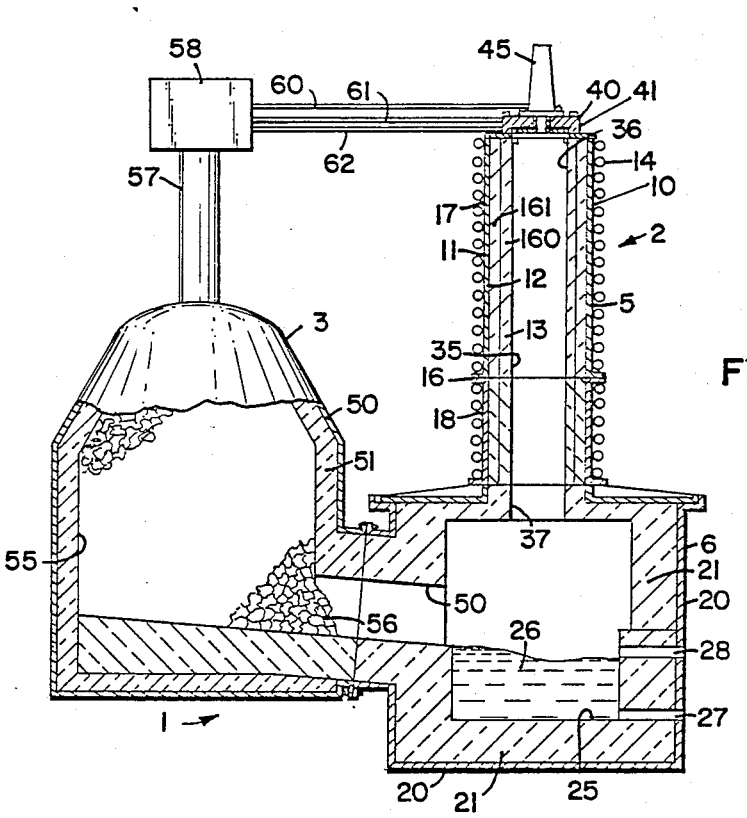
FIG. 1 is a schematic view of a reactor system according to the present invention, the drawing including some elements shown in side cross-sectional elevation or with portions broken away.

The reference numeral 1, FIG. 1, generally designates a refinery modified according to the present invention. The refinery 1 includes two major units, a reactor 2 and a reformer 3. Generally, the metal oxides are reduced in the reactor 2. Product gasses, typically containing carbon dioxide and water, inter alia escaping from the reactor 2 pass through the reformer 3, and are reduced therein to a reducing gas, generally comprising carbon monoxide and hydrogen.

Referring to the reactor 2:

The reactor 2 shown includes a tower portion 5 and a crucible portion 6. The tower portion 5 of the preferred embodiment illustrated and described is a cylindrical pipe extension 10 having an outer wall 11 and an inner wall 12. The inner wall 12 is lined with conventional refractory materials 13, such as alumina or the like, to provide insulation. The outer wall 11 of the pipe 10 includes a spiral cooling tube heat exchanger 14 thereon, to cool the outside of the tower portion 5 in a conventional manner. The dimensions of tower portion 5 may be varied, depending on such criteria as amount of ore to be processed in a given length of time. A typical tower has a height of 2 to 6 feet and an internal diameter of 1 to 2 feet.

The tower portion 5 of the embodiment shown in jointed at location 16 so that it has an upper portion 17 and lower portion 18. In this manner the tower 5 can be modified to include upper portions of various lengths, as may be necessary or preferred for varying applications.

For the embodiment shown, the tower portion 5 extends upwardly from a crucible portion 6. The crucible portion 6 has an outer wall 20 lined with refractory material 21. The outer wall 20 and refractory material 21 defining an internal crucible chamber 25 in which molten metal 26 is received during reactor operation. Drain 27 provides for removal of the molten material 27. An upper tap 28 may be provided to facilitate removal of slag which may form on top of the molten material 26. Drain 27 and tap 28 may be controlled by conventional means, not shown.

The refractory lined tower portion 5 defines an internal longitudinal bore or chamber 35 in which reduction of the metal oxides occurs. The chamber 35 has an upper end 36 and a lower end 37. The upper end 36 is capped, or enclosed, by a feed plate assembly 40. As described below, feed plate assembly 40 is constructed, according to the present invention, in a manner yielding the particular advantages of the present invention.

Feed plate assembly 40 comprises an end cap 41 closing bore 35 and providing a mount for a plasma torch 45. Plasma torch 45 may be of a conventional design, capable of generating a plasma stream typically in excess of 10,000° F. and often much higher.

As will be understood from the detailed description below, the present invention particularly concerns the manner of and arrangement for introduction of feedstock material into the reaction chamber. Generally, the various feedstock materials are introduced at or near feed plate assembly 40. Plasma torch 45 provides, in operation, a high temperature plasma stream. Generally the plasma stream is formed from a reducing gas comprising material which can be used to reduce the heated metal oxides. Typical examples of such reducing gas are mixtures of carbon monoxide and hydrogen, in various combinations. Other typical components for reducing gasses include various light hydrocarbons such as methane, acetylene, propane and butane. A typical reducing gas for use in a system according to the present invention comprises a mixture substantially exclusively of carbon monoxide and hydrogen, with about 20–40% by volume of hydrogen.

In the reaction chamber, and during the refining process, the reducing gas is used to reduce the metal oxides to the metal, which can drip into the crucible. Gaseous side products from the reactions within the reactor comprise mainly carbon dioxide and water. These materials flow outwardly from the reactor through aperture 50 and into the reformer 3. In the reformer 3, the materials are reformed into a reducing gas, generally by passage through hydrocarbon material such as coke or the like, which reduces the gas.

Referring to FIG. 1, reformer 3 includes an outer wall 50 lined with refractory 51. The outer wall 50 and refractory 51 define an internal chamber 55 filled with a reducing hydrocarbon 56 such as coke or the like. As the gasses flow outwardly from the reactor 2 and into the reformer 3, they pass through the reducing material 56 and are reduced thereby, reforming reducing gas. The reformed reducing gasses are removed from the upper portion of the reformer through takeoff 57. This material may be re-directed into the reactor 2, as described below. In some instances it may be necessary to direct the material into a dryer, scrubber, and/or compressor for treatment prior to injection back into the plasma torch or the feedstock entries. Reference numeral 58 generally designates the equipment which may be used to provide any pretreatment necessary to the gas, and a compression of the gas for entry into the reactor. It will be understood that a variety of conventional units may be used, and that these units need not be located within a single mechanical apparatus, rather a plurality of units and series may be involved. Reference numeral 58 is only intended to generally represent the relative location and the overall process equipment whereat such equipment would typically be located.

Referring to FIG. 1, three feed lines for reducing gas are shown entering the reactor 2. The first of these, line 60, provides the gas which is entered into the plasma torch 45 and is heated and ionized therein. Line 61 designates a reducing gas feed line which is used to carry primary feedstock material into feed plate 40. The primary feedstock material generally comprises the ore material including the metal oxides, obtainable from a hopper or the like, not shown. Line 62 designates a reducing gas feed line for directing secondary feedstock material into a different location in the feed plate 40. The secondary feedstock material generally comprises carbonaceous reducing material and if necessary flux, as described below. This material can be provided from a hopper, not shown.

It will be understood that reducing gas may be fed into any or all necessary locations in the feed plate 40 and plasma torch 45 from sources other than, or in addition to, direct takeoff 57 from the reformer 3.

According to a preferred embodiment of the present invention, feedstock to a plasma torch reactor is separated into two fractions, as indicated above. That is, a first feedstock is fed into a first location, the first feedstock being substantially only the ore material to be reduced. A second feedstock comprising the carbonaceous reducing material and, if necessary, flux is fed into the system at a separate location. Separating the two feedstocks leads to advantages discussed below. Further, the two feedstocks are fed into the reactor 2 in preferred manners leading to advantages also described below. The manner in which the two feedstocks are fed into the system will be understood by reference to FIGS. 2–10, and the following descriptions.

FIG. 2 comprises an exploded perspective view of a preferred feed plate assembly 40 for use according to the present invention. The feed plate assembly 40 depicted comprises an assembly of four basic components. These four components are a main plate or top plate 66, a central ramp member 67, a bottom plate or cap 68 and an insert 69. These four components are shown assembled, in cross-section, in FIG. 3.

Referring to FIG. 2, each of the top plate 66, central ramp 67 and bottom plate 68 includes a central aperture, 71,72,73 respectively, therein. The insert 69 extends through these apertures, for reasons that will become more apparent from the below descriptions.

For the preferred embodiment, FIG. 3, the aperture 71 in the top plate 66 includes a counterbore portion 75 therein. The insert 69 has an outer wall including a narrow portion 76 and a wide portion 77 sized to engage the counterbore 75. In this manner, FIG. 3, the insert 69 is prevented from falling through the central apertures 71,72,73. Pin or screw 80 can be used to engage the insert 69 to retain a selected rotational configuration, for purposes that will be understood from the following descriptions.

Referring to FIGS. 2 and 3, the components 66,67,68 that make up the feed plate assembly 80 are preferably sized to nest with one another. A side wall extension 85 of the bottom cap 68 is appropriately sized to extend upwardly within the central aperture 72 of the central ramp 67, until an upper surface 86, FIG. 3, of the bottom plate 68 engages a lower surface 87 of the top plate 66. The top plate 66 includes an annular flange 90 within which the central ramp 67 and bottom plate 68 seat.

Figure 5:
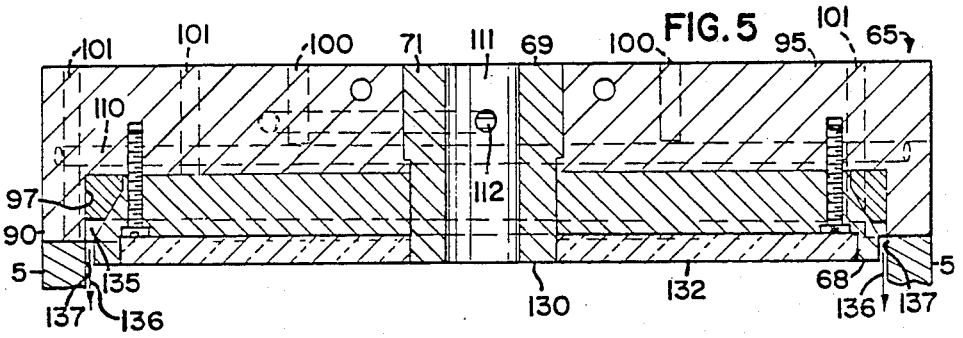
FIG. 5 is an enlarged, fragmentary cross-sectional view of a feed plate assembly according to the present invention shown mounted upon a reaction tower, and generally taken along line 5—5, FIG. 4.

Referring to FIGS. 4 and 5, the feed plate assembly 65 includes an upper surface 95 to which the plasma torch 45, FIG. 1, is mounted during use. The assembly upper surface 95 comprises a surface 96 of the top plate 66 opposite a recess 97 formed by the flange 90. The plasma torch 45 may be mounted by means of bolts or the like, not shown. Referring to FIG. 4, reference numeral 100 designates a circle of bolt holes for mounting the plasma torch 45. The bolt holes 100, FIG. 5, do not extend all the way through the top plate 66.

Referring to FIG. 4, the top plate 66 includes an outer ring of bolt holes 101. Holes 101 extend through the outer flange 90, FIG. 5, and may be used to mount the assembly to the tower 5.

Referring to FIGS. 2, 3 and 5, the central ramp 67 is configured such that it is retained within the top plate recess 97 by the bottom plate 68. The bottom plate 68, FIG. 2, includes a plurality of bolt holes 105 therein through which bolts or the like can be extended to mount the bottom plate 68 against the top plate 66, retaining the central ramp 67 therebetween.

The feed plate assembly 65 may be composed of any of a variety of materials. Conventional feed plates are often manufactured from copper and copper alloys, which have relatively low melting points. Such plates require considerable cooling during use, or they may melt or deform. Cooling for assembly 65 is provided by means of a plurality of horizontal cooling channels 110, FIGS. 4 and 5, which extend completely, horizontally, through the top plate 66. Water or various other coolants may be circulated through the channels during operation of the feed plate assembly, to provide cooling.

As previously indicated, a significant feature of preferred embodiments of the present invention is the preferred method by which feedstock materials are fed into the reactor 2. Specifically, feedstock materials are separated into a primary feedstock and a secondary feedstock. The primary feedstock preferably comprises substantially only the ore, i.e, the metal oxides, to be refined. These materials are fed into the immediate vicinity of the plasma torch, for efficient heating to a very high temperature in the presence of the reducing, plasma, gas. The secondary feedstock comprises hydrocarbonaceous material, providing a source of reductant, and if desired, flux, such as limestone, used to generate silicates of relatively low melting point within the reactor. The secondary feedstock is fed into the reactor at a site more remote from the plasma torch. In this way substantial energy of the plasma torch is not lost in heating the secondary feedstock materials, in the immediate presence of the primary feedstock material. Further, according to the present invention, the secondary feedstock material is fed into the reactor in a preferred pattern, yielding advantages described below.

Feeding of the primary feedstock material into the reactor 2 is generally as follows:

Referring to FIG. 5, generally the primary feedstock material is fed into the plasma stream from the plasma torch 45 at the aperture 71 of the top plate 66. The manner in which the primary feedstock materials are fed into the plasma stream differs substantially from many conventional methods, wherein feedstock materials are generally fed directly into the plasma stream. According to the present invention, the primary feedstock materials are fed into the annular chamber through which the plasma flows, along a path generally swirling around an edge of the chamber. That is, they are not fed directly into the center of the plasma stream. Referring to FIG. 5, reference numeral 111 generally designates a bore defined by insert 69 and aperture 71, through which a stream of plasma from the plasma torch extends, during operation. Generally, the plasma stream is centered within bore 111, during most uses. Reference numeral 112, FIG. 5, indicates channel extending through the top plate 66 and the insert 69, through which primary feedstock material is fed into the bore 111. It will be understood by inspection of FIG. 5, that channel 112 is oriented to direct primary feedstock material toward a wall of the bore 111, rather than directly toward the center, i.e. rather than directly toward the plasma stream. In a preferred embodiment of the present invention, the center line of feed tube or channel 112 perpendicularly intersects a radius of the plasma bore hole 111 a distance of at least about ½ and preferably about ⅔ of the bore hole radius from the center. Thus, it is oriented slightly inwardly from a tangent to the bore 111 wall. This is shown in FIG. 4.

In the preferred embodiment, bore 111 is relatively narrow compared to chamber 35, so that the primary feedstock is initially kept in very close proximity to the plasma stream, before it is expelled into chamber 35. For a typical application, bore 111 has a diameter of about 1–5 inches, and preferably about 3 inches.

As a result of the above-described entry of primary feedstock material, a swirling pattern is formed in bore 111 immediately around and in the immediate vicinity of the plasma stream, before the material enters the expanded reaction chamber 35. As a result of the swirling pattern, primary feedstock material may be retained within the bore 111 a slightly longer period of time than would otherwise be the case. Although this time period may be very small, it will result in a slightly longer exposure of the primary feedstock materials to the intense heat of the plasma stream, and result in a substantially greater approach toward chemical and physical equilibria. That is, the primary feedstock materials are heated to a substantially higher temperature and reaction at that higher temperature, with the plasma gas, can proceed further. Also, the swirling pattern, a corkscrew or helical pattern, of the primary feedstock materials will result in a saving of the refractory material 13, which lines the wall of the tower portion 5. This occurs because deflection of the very hot primary feedstock material will be more radially random. That is, in those conventional systems wherein the feedstock material is fed directly toward the center of the plasma stream, the hot particles are deflected preferably at a particular angle to the entry angle, and thus statistically have a greater likelihood of hitting certain selected areas of the refractory wall. For the present system, on the other hand, the helical trajectory upon entering the immediate vicinity of the plasma stream, in bore 111, results in a more random deflection pattern of hot particles as they are expelled into chamber 35, and less excessive stress on any particular point of the refractory wall.

To facilitate this latter advantage, and to enable smooth entry of feedstock material into bore 111, the preferred assembly, FIG. 4, is provided with three feed channels 112,113,114 positioned approximately 120° apart. The result is a helical, swirling pattern of the primary feedstock materials yielding the advantages described.

Separation of the feedstock materials into the primary and secondary groups, for the preferred application as indicated above, leads to an advantage in that the only feedstock material in the bore 111 and in immediate proximity to the plasma torch is the primary feedstock material comprising the ore to be reacted. Thus, efficiency in heating is obtained, since the hydrocarbonaceous material and flux are not also intensely heated by the close proximity to the plasma torch. That is, they do not draw substantial energy therefrom. Further, as a result of the separation, a greater concentration of primary feedstock material can be obtained within bore 111 at a given time. The secondary feedstock materials can be used to advantage, as described below.

It will be understood that insert 69 will be subject to very intense heat and bombardment from hot materials, since it is positioned immediately surrounding the area of the initial contact between the primary feedstock material and the plasma torch. An advantage to the arrangement described and shown is that the insert 69 can be readily removed and replaced, should substantial wear occur during use.

Preferably, the insert 69 is composed of a material having a high melting point and relatively low thermal conductivity, for enhanced lifetime. Suitable insert materials include steel and refractory materials. It will be understood that as a result of the low thermal conductivity, by comparison to copper, the inner wall or bore 111 of the insert 69 will be substantially hotter than would be an inner wall of a cooled plate, such as top plate 66. As a result, the temperature gradient between the center of bore 111 and its wall is substantially less, or drops off less rapidly, for the present feed plate assembly 80 than for many conventional systems. Thus, the effective bore, or working bore, is increased in diameter. That is, higher temperatures are found in a greater volume of the same size of bore in the present assembly 40 than would be found in a bore in a conventional copper plate having no liner. This results in greater efficiency of reaction, since a higher volume of primary feedstock material can be reacted within a given period of time.

As previously suggested, the secondary feedstock materials, according to the present invention, are fed into the reactor 2 in a pattern developing a protective liner or wall for the refractory wall 13 of the tower 5. In this manner, they will generally absorb much of the hot primary feedstock material as it is directed toward the refractory wall, limiting damage to the wall and increasing lifetime without need to shut down to replace lining. Further, the secondary feedstock material will lay down a hydrocarbonaceous, reducing, film or tar on the refractory wall, protecting same and providing for reduction of the hot metal oxides from primary feedstock material. The direction of the secondary feedstock material into the reactor 2 is provided, primarily, by the central ramp 67 and bottom plate 68, of the feed plate assembly 40.

Referring to FIG. 3, the bottom plate 68 includes a lower recessed surface 120, an outer downwardly projecting flange 121, an inwardly slanted wall 122 and upper surface 86. For the preferred embodiment inwardly slanted wall 122 comprises a truncated conical wall 124 having an upper extension 125 thereon.

Referring to FIG. 3, insert 69 includes an extension 130 thereon which defines an internal exit for bore 111 and which extends through bore 73 and bottom plate 68, to form a washer-shaped recess area 131 with the lower surface 120 of bottom plate 68. Area 131 may be filled with refractory material 132, or the like, to protect assembly 40 against hot materials within the reactor 2.

Referring to FIG. 5, secondary feedstock material is fed into an annular space, gap, or channel 135 defined between flange 90 of top plate 66, and the bottom plate 68. Channel 135, being annular, provides that secondary feedstock material will fall in a circular pattern, preferably completely surrounding central bore 111 and the plasma stream, with the protective wall being positioned between the plasma stream and the tower wall refractory. Referring to FIG. 5, the protective wall extends downwardly along the path indicated by arrows 136 and is preferably oriented substantially adjacent to tower wall 137.

Figure 10:
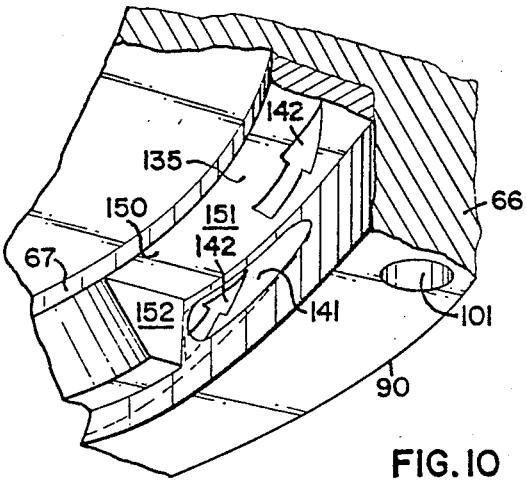
FIG. 10 is an enlarged, fragmentary cross-sectional view of a portion of a feed plate assembly according to the present invention.

FIG. 10 illustrates assembly 40 with the bottom plate 68 removed. Flange 90 of the top plate 66 is illustrated with the channel 135 immediately thereagainst. Secondary feedstock material is directed into channel 135 through aperture or channel 141, along the general direction of arrows 142. That is, it is directed substantially tangentially along flange 90, so that it will swirl in a helical pattern along the wall 90. In this manner it is distributed completely around the bottom plate 68, FIG. 5, to fall therefrom in the preferred protective pattern.

Advantages are derived from the manner, according to the present invention, in which the protective wall of secondary feedstock material is formed. Generally, the secondary feedstock material, being a powdered hydrocarbonaceous material and sometimes including flux therein, is blown into the channel 135 by means of a carrier fluid, preferably including or comprising a reducing gas. Immediately upon entering the channel 135, that is immediately exterior to channel 141, some of the material will begin falling from the channel 135 along the outer flange 121 of the bottom plate 68, FIGS. 6, 7, 8 and 9. In particular, the material falls in the direction of arrows 143, FIGS. 6, 7, 8 and 9. As a result, at further distances along the circular path of channel 135 less carrier gas and secondary feedstock material will be found. According to the present invention, means are provided for the preferred embodiment to ensure a protective wall of relatively uniform thickness throughout, that is substantially the same amount of secondary feedstock material will fall from channel 135 throughout its complete extension. This is accomplished by providing means tapering the size of chamber 135 throughout its extension. For the preferred embodiment a tapering means providing for this is generated by ramp 67.

Referring to FIGS. 2 and 10, the preferred ramp 67 comprises a ring 150 defining a ramp surface 151 increasing in height or depth, and narrowing in width, throughout its circular extension, until reaching an end drop-off surface 152 oriented behind flow from channel 141. As a result of the ramp surface 151, channel 135 becomes smaller and smaller in cross-section throughout its extension, from its widest point immediately adjacent channel 141 to its smallest point immediately behind channel 141; that is, at the very end of a 360° arcuate travel of secondary feedstock material blown into gap 135 through channel 141. Channel 135, which for the preferred embodiment has a more or less triangular cross-section, as a result of this arrangement becomes squeezed smaller and smaller, throughout its extension. As a result, a relatively constant escape of secondary feedstock material therefrom, along its entire length, may be maintained if desired.

Referring to FIG. 10, channel 135 for the preferred embodiment never decreases to zero, so no end wall is provided that would completely deflect secondary feedstock material. That is, for the preferred embodiment a complete 360° circular flow pattern of secondary feedstock material is provided.

It is foreseen that it may be desirable to utilize a central ramp 67 of various configurations under different circumstances. Therefore, for the preferred assembly 40 of the present invention, ramp 67 is a separate unit which may be removed and be replaced, as desired. Therefore, if a non-constant escape from gap 135 is desired, it can be provided. It will be understood, however, that central ramp 67 could, under some circumstances, be integral with either the top plate 66 or the bottom plate 68. Also, the entire assembly 40 may comprise a single molded member or a plurality of members attached to one another.

Figure 6:
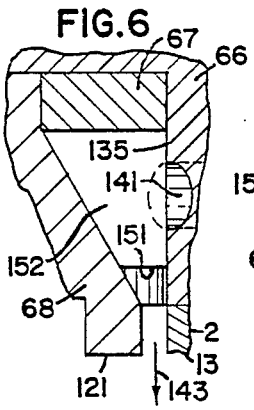
FIG. 6 is an enlarged, fragmentary cross-sectional view taken generally along line 6—6, FIG. 4.

The continually decreasing cross-section of gap 135 will be best understood by reference to FIGS. 4, 6, 7, 8 and 9. FIGS. 6, 7, 8 and 9 comprise cross-sections through gap 135, taken at different points throughout the radial arcuate extension of channel 135, which can be understood by reference to FIG. 4. FIG. 6 is a cross-section taken in the immediate vicinity of channel 141 looking back against the incoming flow of secondary feedstock material. Wall 152 is immediately viewable with ramp surface 151 at the bottom thereof. At this point gap 135 has its greatest cross-section, although it is being viewed in the direction of a recessed wall 152 which narrows channel 135 to its smallest cross-section.

Figure 7:
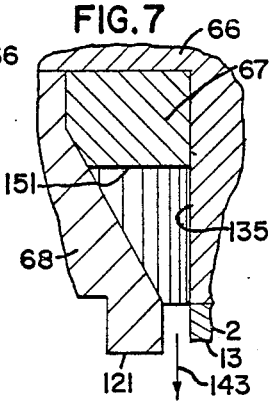
FIG. 7 is an enlarged, fragmentary cross-sectional view taken generally along line 7—7, FIG. 4.
Figure 8:
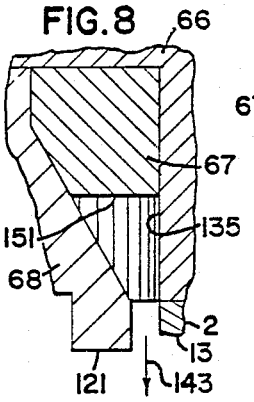
FIG. 8 is an enlarged, fragmentary cross-sectional view taken generally along line 8—8, FIG. 4.
Figure 9:
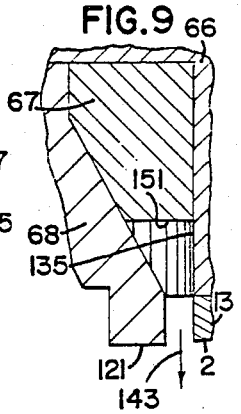
FIG. 9 is an enlarged, fragmentary cross-sectional view taken generally along line 9—9, FIG. 4.

In FIG. 7, gap 135 is viewable having been reduced in size partly by ramp surface 151 having begun to decline toward the top of tower 2. In FIG. 8, gap 135 is decreased even more, and in FIG. 9 channel 135 is decreased even more.

It will be understood that if substantial pressure is used for the fluid bringing secondary feedstock material into channel 135, material falling from gap 135 will not drop perpendicularly downwardly, but rather will fall in a swirling pattern. That is, the protective wall will fall in a swirling pattern toward the bottom of tower 2. As a result, retention time of secondary feedstock within the tower 2 is increased, since swirling material falls somewhat more slowly, due to its lateral component of momentum. An advantage results from this since less secondary feedstock material may be needed at any given time, to provide a substantial protective lining.

The primary feedstock material and the secondary feedstock material need not necessarily be directed into the reactor 2 at the same time. At initial start up, it may be desirable to initially start the secondary feedstock material, to insure that a protective wall is in place, before the primary feedstock material is fed into the plasma stream. In some instances, heat within tower 2 will cause some of the hydrocarbonaceous material of the protective wall to form a tar, sticking to the refractory protecting same. When a refinery is first put into operation, the secondary feedstock material and the plasma stream may be used, together, to lay down the protective tar on the tower wall, before the primary feedstock material is even initially feed into the plasma stream.

In typical operation, it may be desirable to empirically determine an equilibria for a protective tar laid down upon the refractory wall, by the secondary feedstock material. That is, an initial protective coating may be formed, with the rate of secondary feedstock material from that point on being fed into the system at a rate reforming or replacing the protective coating at approximately the same rate that heated primary feedstock material causes decomposition of the tar surface. Generally appropriate feed rates for primary and secondary feedstock materials, in order to accomplish this, can be determined empirically. Referring to FIGS. 2 and 4, channel 156 in assembly 40 can be provided, so that sensing equipment, such as a pressure tap, can communicate from within the reactor 2, to external equipment, for monitoring processes within the reactor 2 and, if necessary, determining appropriate flow rates for primary and secondary feedstocks.

It will be readily understood that a variety of feedstock materials may be utilized in conjunction with the principles of the present invention. For a typical reduction of iron ore, a relatively fine taconite is desirable as the primary feedstock material. Taconite powdered to at least 90% finer than 400 mesh is readily usable. Generally, all that is required is that the metal oxide be sufficiently fine to be readily pneumatically transported into the reactor 2.

The secondary feedstock material need not be quite as fine, since it is less important that it be rapidly heated throughout, for efficient reaction. Generally, carbonaceous material on the order of about 200 mesh is quite suitable.

Flow rates of the carrier gasses for the primary and secondary feedstock materials, as indicated above, can be varied depending upon the size of the reactor and efficiency of reaction detected. Generally, these will be determined empirically for each reactor size, and each ore material and secondary refractory material used. Complete blockage of the reactor by tar formation on the refractory walls will generally not be a problem, due to the presence of the very hot plasma stream tending to burn a hole through the tar material.

An advantage to the present invention, as indicated above, is that it results in a saving of refractory material. As a result, a thinner refractory lining may be used, than was available for use with conventional systems. In some instances it may be desirable to use an expensive refractory material for only a relatively thin layer, backed by a conventional fire break or the like, to provide a sufficient thermal barrier. This is illustrated in FIG. 1 wherein refractory 13 is shown in two layers, an inner layer 160 and an outer layer 161. As a result, substantial savings and expense may occur.

It is to be understood that while certain embodiments of the present invention have been illustrated and described, it is not to be limited as to specific forms or arrangement of parts herein described and shown.

What is claimed and desired to be secured by letters patent:

1. A process for the reduction of metal oxides by means of a plasma heated stream in a reactor, said process including the-steps of:
   (a) providing a reactor including a feed plate assembly and a plasma torch, the feed plate assembly including a bore therein for passage of a plasma heated stream therethrough;
   (b) providing a primary feedstock material consisting essentially of ore material including metal oxide to be reduced;
   (c) providing a secondary feedstock material including hydrocarbonaceous reductant;
   (d) feeding said primary feedstock material into proximity to the plasma heated stream in the feed plate assembly bore; and
   (e) feeding said secondary feedstock material into the reactor at a position more remote from said plasma stream than the feed plate assembly bore;
   (f) whereby the hydrocarbonaceous reductant in said secondary feedstock is not fed into the plasma heated stream with said primary feedstock material.

2. The process according to claim 1 wherein said secondary feedstock material includes flux material.

3. The process according to claim 1 wherein said secondary feedstock material is fed into the reactor in a pattern providing a protective lining over a wall of said reactor, protecting same from hot primary feedstock material expelled from the feed plate assembly bore.

4. The process according to claim 3 wherein:
   (a) the feed plate assembly bore is circular in cross-section and has a central longitudinal axis and a radius;
   (b) the plasma heated stream is centered substantially along the bore central longitudinal axis; and
   (c) said primary feedstock material is directed into said bore along a path of motion substantially orthogonal to said longitudinal axis and substantially off-set from said longitudinal axis.

5. The process according to claim 4 wherein:
   (a) said primary feedstock material path of motion is substantially perpendicular to a radius of said longitudinal bore and is off-set from said central axis a distance of at least about one-half a length of said radius.

6. The process according to claim 4 wherein said primary feedstock material is fed into said bore along a plurality of separate streams spaced from one another, each of which has a direction of motion substantially orthogonal to said longitudinal axis and substantially off-set from said longitudinal axis.

7. The prdcess according to claim 6 including three streams of primary feedstock material each having a direction of motion substantially perpendicular to a separate radius of said longitudinal bore and each off-set from said central longitudinal axis a distance at least about one-half a length of said bore radius.

8. The process according to claim 1 wherein:
   (a) the feed plate assembly bore is circular in cross-section and has a central longitudinal axis and a radius;
   (b) the plasma heated stream is centered substantially along the bore central longitudinal axis; and
   (c) said primary feedstock material is directed into said bore along a path of motion substantially orthogonal to said longitudinal axis and substantially off-set from said longitudinal axis.

9. The process according to claim 8 wherein:
   (a) said primary feedstock material path of motion is substantially perpendicular to a radius of said longitudinal bore and is off-set from said central axis a distance of at least about one-half a length of said radius.

10. The process according to claim 8 wherein said primary feedstock material is fed into said bore along a plurality of separate streams spaced from one another, each of which has a direction of motion substantially orthogonal to said longitudinal axis and substantially off-set from said longitudinal axis.

11. The process according to claim 10 including three streams of primary feedstock material material each having a path of motion substantially perpendicular to a separate radius of said longitudinal bore and off-set from said central longitudinal axis a distance at least about one-half a length of said bore radius.

12. A process for the reduction of metal oxides by means of a plasma heated stream in a reactor, said process including the steps of:
   (a) providing a reactor including a feed plate assembly and a plasma torch, the feed plate assembly including a bore therein for passage of a plasma heated stream therethrough;
   (b) providing a primary feedstock material including an ore material to be reduced;
   (c) providing a secondary feedstock material including hydrocarbonaceous reductant;

(d) feeding said primary feedstock material into proximity to the plasma heated stream in the feed plate assembly bore; and (e) feeding said secondary feedstock material into the reactor in a pattern providing a protective lining over a wall of said reactor, protecting same from hot primary feedstock material expelled from the feed plate assembly bore.

13. A process according to claim 12 wherein:

(a) the reactor includes a circular tower having an inner wall and the feed plate assembly mounted in an upper end thereof; and (b) said secondary feedstock is fed into the tower in a pattern forming a circular lining extending between said circular tower inner wall and the plasma heated stream.

14. A feed plate assembly for mounting in a reactor in which metal oxides are reduced following heating by a plasma heated stream; said feed plate assembly comprising:

(a) a top plate portion having a central longitudinal bore extending therethrough;

(i) said top plate portion including means for mounting a plasma torch thereon with a plasma stream extending outwardly therefrom directed through said top plate central bore and into an associated reactor;

(ii) said top plate portion including at least one first feedstock channel oriented for delivery of a first feedstock material into said central bore; and (b) a second feedstock portion including an annular secondary feedstock wall constructed and arranged to release a protective wall of secondary feedstock material in a flow pattern surrounding an internal exit of said central longitudinal bore;

(c) whereby a first feedstock material including metal oxides to be reduced may be fed into said reactor by said first feedstock channel; and, whereby a second feedstock material including hydrocarbonaceous reductant therein may be fed into said reactor by said secondary feedstock channel to provide a protective wall therein.

15. A feed plate assembly according to claim 14 wherein said second feedstock portion is constructed and arranged to provide a protective wall, of the hydrocarbonaceous reductant, of a substantially uniform thickness.

16. A feed plate assembly according to claim 14 wherein:

(a) said secondary feedstock channel includes a secondary feedstock inlet; and (b) said secondary feedstock channel varies in cross-sectional size throughout an arcuate extension from a location immediately downstream from said secondary feedstock inlet.

17. A feed plate assembly according to claim 16 wherein said secondary feedstock channel decreases in size throughout said arcuate extension.

18. A feed plate assembly according to claim 17 wherein:

(a) said decrease in side of said secondary feedstock channel is substantially constant throughout an arcuate extension thereof.

19. A feed plate assembly according to claim 14 wherein:

(a) said top plate portion is formed from a material having a first thermal conductivity and a first melting point; and (b) said top plate central bore includes a removable liner therein; said liner being formed from a material having a second thermal conductivity and a second melting point;

(i) said second thermal conductivity being lower than said first; and (ii) said second melting point being higher than said first.

20. An apparatus for delivering feedstock material to a reactor in which metal oxides are reduced upon heating in the presence of a reductant; said apparatus oomprising:

(a) a top plate having a central longitudinal bore extending therethrough; said bore having a longitudinal axis;

(i) said top plate including at least one lateral first feedstock channel therein oriented for delivery of a first feedstock material into said top plate central bore;

(b) a bottom plate; and (c) a ring member positioned between said top plate and said bottom plate and forming an annular second feedstock channel therewith;

(i) said annular second feedstock channel being oriented to surround said bore longitudinal axis;

(ii) said annular second feedstock channel being constructed and arranged to release a protective wall of secondary feedstock material in an annular flow pattern for surrounding an internal exit of said bore; and (d) means for introducing secondary feedstock material into said second feedstock channel;

(e) whereby a first feedstock material including metal oxides to be reduced may be fed into said reactor by said first feedstock channel; and, whereby a second feedstock material may be fed into said reactor by said secondary feedstock channel to provide a protective wall therein.

21. An apparatus according to claim 20 wherein:

(a) said top plate includes a annular mounting flange;

(b) said bottom plate is sized to be received within said top plate lower annular mounting flange;

(c) said ring member comprises a circular ramp positioned between said bottom plate and said top plate flange; and, (d) said flange includes a secondary feedstock flow aperture therein for feeding a secondary feedstock into said second feedstock channel;

(e) whereby said ring member is removable and replaceable.

22. An apparatus according to claim 21 wherein:

(a) said bottom plate has a truncated, conical, side portion; and (b) said second feedstock channel is formed from said bottom plate conical side portion, said circular ramp and said top plate flange.

23. The apparatus according to claim 22 wherein:

(a) said circular ramp is constructed and arranged to decrease in cross-sectional area of the feedstock channel throughout a circular extension thereof.

* * * * *